US008862038B2

(12) United States Patent
Yamamoto et al.

(10) Patent No.: US 8,862,038 B2
(45) Date of Patent: Oct. 14, 2014

(54) FIXING DEVICE AND IMAGE FORMING APPARATUS INCORPORATING SAME

(75) Inventors: Takeshi Yamamoto, Kanagawa (JP); Naoto Suzuki, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 183 days.

(21) Appl. No.: 13/206,966

(22) Filed: Aug. 10, 2011

(65) Prior Publication Data

US 2012/0045260 A1 Feb. 23, 2012

(30) Foreign Application Priority Data

Aug. 20, 2010 (JP) ..... 2010-184911
May 25, 2011 (JP) ..... 2011-117043

(51) Int. Cl.
*G03G 15/20* (2006.01)

(52) U.S. Cl.
CPC .... *G03G 15/2028* (2013.01); *G03G 2221/1645* (2013.01)
USPC ..... 399/323

(58) Field of Classification Search
USPC ..... 399/122, 320–323; 271/307, 309, 312, 271/900
See application file for complete search history.

(56) References Cited

U.S. PATENT DOCUMENTS 7,062,211 B2 * 6/2006 Baba et al. ..... 399/323
7,283,777 B2 * 10/2007 Russel et al. ..... 399/322
8,162,315 B2 * 4/2012 Baba ..... 271/312
8,340,560 B2 * 12/2012 Okuno et al. ..... 399/323
2006/0257183 A1 11/2006 Ehara et al.
2009/0274477 A1 11/2009 Okamoto et al.
2009/0274494 A1 11/2009 Okamoto et al.
2009/0274495 A1 11/2009 Okamoto et al.
2009/0274496 A1 11/2009 Okamoto et al.
2009/0274497 A1 11/2009 Okamoto et al.
2009/0274498 A1 11/2009 Okamoto et al.

(Continued)

FOREIGN PATENT DOCUMENTS

JP 51-104350 9/1976
JP 8-16018 1/1996

(Continued)

OTHER PUBLICATIONS

U.S. Appl. No. 12/986,425, filed Jan. 7, 2011, Takashi Seto, et al.

(Continued)

*Primary Examiner* — Hoan Tran
(74) *Attorney, Agent, or Firm* — Oblon, Spivak, McClelland, Maier & Neustadt, L.L.P.

(57) ABSTRACT

A fixing device includes a rotary fuser member, a rotary pressure member, a first media stripper, and a second media stripper. The rotary fuser member is subjected to heating. The rotary pressure member is pressed against the fuser member to form a fixing nip therebetween through which a recording medium is passed in a media conveyance direction under heat and pressure as the fuser and pressure members rotate together. The first media stripper includes at least one pneumatic nozzle disposed adjacent to the fuser member to direct compressed gas toward the fixing nip along the fuser member for stripping the recording medium from the fuser member. The second media stripper includes at least one contact finger disposed in contact with the pressure member to slide against the pressure member during rotation for stripping the recording medium from the pressure member.

16 Claims, 6 Drawing Sheets

(56) References Cited

U.S. PATENT DOCUMENTS

| | | | |
|---|---|---|---|
| 2009/0297199 | A1 | 12/2009 | Yamashina et al. |
| 2010/0239292 | A1 | 9/2010 | Fujita et al. |
| 2010/0316397 | A1 | 12/2010 | Kudou et al. |
| 2011/0164904 | A1 | 7/2011 | Hirose et al. |
| 2011/0182609 | A1 | 7/2011 | Hasegawa et al. |

FOREIGN PATENT DOCUMENTS

| | | |
|---|---|---|
| JP | 2876217 | 1/1999 |
| JP | 11-334191 | 12/1999 |
| JP | 2005-107507 | 4/2005 |
| JP | 2007-187715 | 7/2007 |
| JP | 2007-240920 | 9/2007 |
| JP | 2008-102408 | 5/2008 |
| JP | 2009-31759 | 2/2009 |
| JP | 2009-271115 | 11/2009 |

OTHER PUBLICATIONS

Chinese Office Action issued Nov. 4, 2013 for Chinese Patent Application No. 201110228253.0.

* cited by examiner

FIXING DEVICE AND IMAGE FORMING APPARATUS INCORPORATING SAME

CROSS-REFERENCE TO RELATED APPLICATIONS

The present patent application claims priority pursuant to 35 U.S.C. §119 from Japanese Patent Application Nos. 2010-184911 and 2011-117043, filed on Aug. 20, 2010 and May 25, 2011, respectively, which are hereby incorporated by reference herein in their entirety.

BACKGROUND OF THE INVENTION

1. Field of the Invention

The present invention relates to a fixing device and an image forming apparatus incorporating the same, and more particularly, to a fixing device that fixes a toner image in place on a recording medium with heat and pressure, and an electrophotographic image forming apparatus, such as a photocopier, facsimile machine, printer, plotter, or multifunctional machine, incorporating such a fixing device.

2. Description of the Background Art

In electrophotographic image forming apparatuses, such as photocopiers, facsimile machines, printers, plotters, or multifunctional machines incorporating several of those imaging functions, an image is formed by attracting toner particles to a photoconductive surface for subsequent transfer to a recording medium such as a sheet of paper. After transfer, the imaging process is followed by a fixing process using a fixing device, which permanently fixes the toner image in place on the recording medium by melting and settling the toner with heat and pressure.

Various types of fixing devices are known in the art, most of which employ a pair of generally cylindrical looped belts or rollers, one being heated for fusing toner ("fuser member") and the other being pressed against the heated one ("pressure member"), which together form a heated area of contact called a fixing nip through which a recording medium is passed to fix a toner image onto the medium under heat and pressure.

One such fixing device includes a multi-roller, belt-based fuser assembly that employs an endless, flexible fuser belt entrained around multiple rollers, one of which is equipped with an internal heater to heat the length of the fuser belt through contact with the heated roller. The fuser belt is paired with a pressure roller pressed against the outer surface of the fuser belt to form a fixing nip therebetween, at which a toner image is fixed in place with heat from the fuser belt and pressure from the pressure roller.

Owing to the fuser belt which exhibits a relatively low heat capacity and therefore can be swiftly heated, the belt-based fuser assembly eliminates the need for keeping the heater in a sufficiently heated state when idle, resulting in shorter start-up time and smaller amounts of energy wasted during standby, as well as a relatively compact size of the fuser assembly.

One important factor that determines imaging quality of a fixing device is the ability to properly convey a recording medium through the fixing nip without causing the recording medium to wrap around the rotary fixing member. Media wraparound occurs where the toner image heated through the fixing nip becomes sticky and thus adheres to the surface of the fixing member upon exiting the fixing nip. If not corrected, a recording medium wrapping around the fixing member would cause jam or other conveyance failure in the fixing nip.

For obtaining a fixing process with high immunity against media wraparound and concomitant conveyance failure, a fixing device may use a fuser roller or belt coated with a release agent such as fluorine resin where it contacts a heated, sticky toner image in the fixing nip, while equipped with a media stripping mechanism that allows a recording medium to properly separate from the fuser member at the exit of the fixing nip.

For example, in monochrome printing, a fuser roller includes a cylindrical body of metal coated with polytetrafluoroethylene (PTFE) commercially available under the trademark Teflon®. The metallic fuser roller is durable and highly immune to abrasion or other damage caused by continuous contact with the media stripping mechanism.

On the other hand, in multi-color printing, a fuser roller often includes a cylindrical body covered by an outer elastic layer of silicone rubber or the like with a coating of oil or fluorine resin deposited thereon (e.g., a rubber-covered roller with a several tens micron-thick tubular coating of perfluoroalkoxy fitted thereupon). The rubber-covered roller allows for good reproduction of color, while relatively vulnerable to damage as the outer elastic layer readily abrades due to continuous contact with the media stripping mechanism, resulting in streaks or other imperfections in a resulting image.

A practical approach to prevent damage to the fuser member and concomitant image defects is to use a non-contact media stripping mechanism that can strip a recording medium without touching the fuser member. One example of such non-contact media stripper is an elongated mechanical assembly, such as a thin-edged stripping plate or a plurality of interspersed stripping fingers arranged in line, which extends parallel to a length of the fuser member with a spacing of approximately 0.2 mm to approximately 1.0 mm left between the separator and the fuser member. Another example is a self-stripping system that optimizes curvature and elasticity of a fixing member forming a fixing nip to promote self-stripping action, in which a recording medium having a specific stiffness or beam strength separates by itself from the fixing member.

Although effective for their intended purposes, the non-contact stripping methods depicted above would not work properly, where the recording medium in use exhibits a greater than usual tendency to follow or adhere to the fixing member, and eventually enters a gap, if any, left between the fixing member and an adjoining guide or stripper structure. Such deflection of a recording medium from a proper conveyance path would cause the recording medium to wrap around the fuser member, or otherwise unduly interfere with the media stripper, resulting in jam and other concomitant conveyance failure in the fixing nip.

To date, a still another non-contact stripping method is proposed, which employs a pneumatic nozzle that directs air to an interface between a fuser member and a printed face of a recording medium, so as to pneumatically force the recording medium to separate from the fuser member at the exit of a fixing nip. Such pneumatic media stripper is designed with a sufficiently large pneumatic stripping force (which may be determined, for example, by pressure and amount of air discharged from the nozzle) to accommodate a most difficult situation where the recording medium has a pronounced tendency to follow or adhere to the fixing member, so as to ensure reliable stripping performance for normal, easier conditions under which the fixing device is normally operated.

SUMMARY OF THE INVENTION

Exemplary aspects of the present invention are put forward in view of the above-described circumstances, and provide a novel fixing device that fixes a toner image in place on a recording medium.

In one exemplary embodiment, the novel fixing device includes a rotary fuser member, a rotary pressure member, a first media stripper, and a second media stripper. The rotary fuser member is subjected to heating. The rotary pressure member is pressed against the fuser member to form a fixing nip therebetween through which the recording medium is passed in a media conveyance direction under heat and pressure as the fuser and pressure members rotate together. The first media stripper includes at least one pneumatic nozzle disposed adjacent to the fuser member to direct compressed gas toward the fixing nip along the fuser member for stripping the recording medium from the fuser member. The second media stripper includes at least one contact finger disposed in contact with the pressure member to slide against the pressure member during rotation for stripping the recording medium from the pressure member.

Other exemplary aspects of the present invention are put forward in view of the above-described circumstances, and provide a novel image forming apparatus.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION OF PREFERRED EMBODIMENTS

Figure 1:
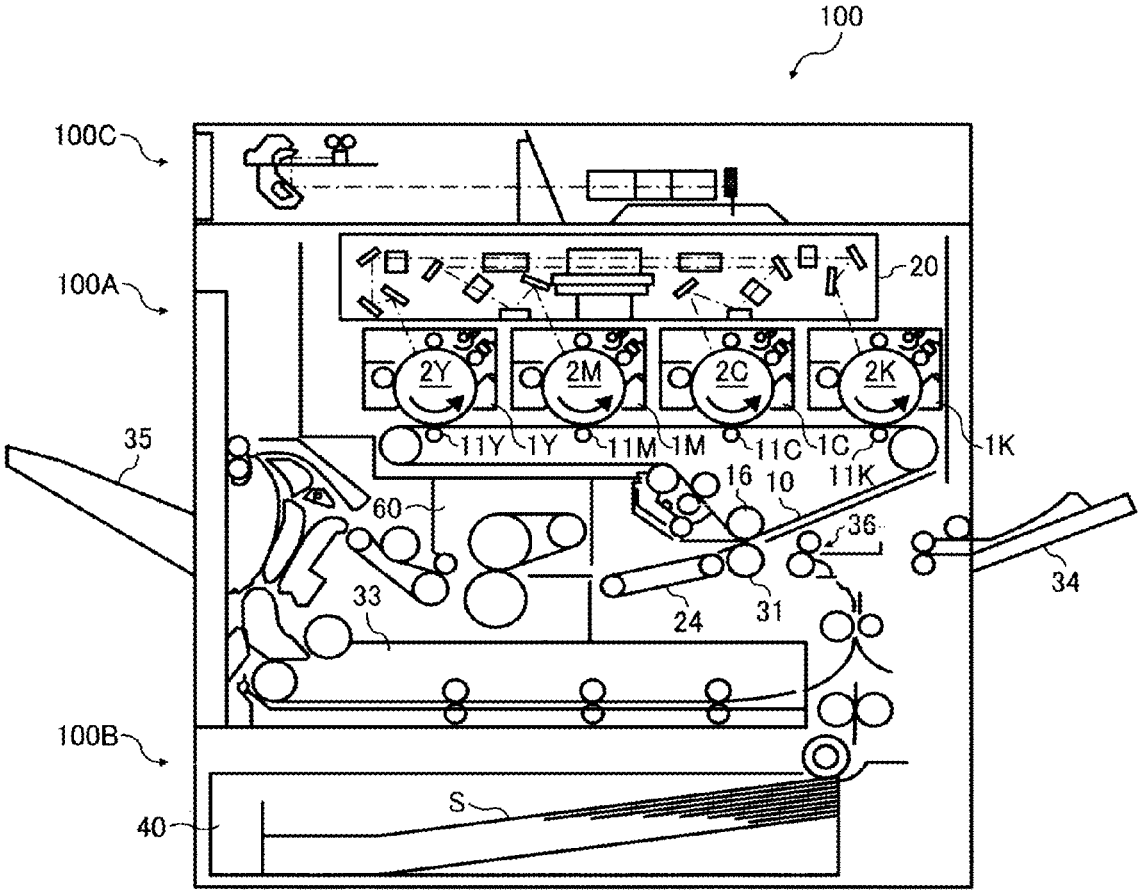
FIG. 1 schematically illustrates an image forming apparatus incorporating a fixing device according to this patent specification.

In describing exemplary embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

Referring now to the drawings, wherein like reference numerals designate identical or corresponding parts throughout the several views, exemplary embodiments of the present patent application are described.

FIG. 1 schematically illustrates an image forming apparatus 100 incorporating a fixing device 60 according to this patent specification.

As shown in FIG. 1, the image forming apparatus 100 is a digital color imaging system that can print a color image on a recording medium such as a sheet of paper S according to image data, consisting of a generally upper, printer section 100A, and a generally lower, sheet feeding section 100B combined together to form a freestanding unit, on top of which may be deployed an appropriate image scanner 100C, that allows for capturing image data from an original document.

The printer section 100A comprises a tandem color printer that forms a color image by combining images of yellow, magenta, and cyan (i.e., the complements of three subtractive primary colors) as well as black, consisting of four electrophotographic imaging stations 1Y, 1M, 1C, and 1K arranged in series substantially laterally along the length of an intermediate transfer belt 10, each forming an image with toner particles of a particular primary color, as designated by the suffixes "Y" for yellow, "M" for magenta, "C" for cyan, and "K" for black.

Each imaging station 1 includes a drum-shaped photoconductor 2 rotatable counterclockwise in the drawing, having its outer, photoconductive surface exposed to an exposure device 20 while surrounded by various pieces of imaging equipment, such as a charging device, a development device accommodating toner of the associated primary color, a primary transfer device incorporating an electrically biased, primary transfer roller 11, a cleaning device for the photoconductive surface, etc., which work in cooperation to form a primary toner image on the photoconductor 2 for subsequent transfer to the intermediate transfer belt 10 at a primary transfer nip defined between the photoconductive drum 2 and the primary transfer roller 11.

The intermediate transfer belt 10 is trained around multiple support rollers to rotate clockwise in the drawing, passing through the four primary transfer nips sequentially to carry thereon a multi-color toner image toward a secondary transfer nip defined between a secondary transfer roller 31 and a backup roller 16, at which the toner image is transferred to a recording sheet S fed from the sheet feeding section 100B.

The sheet feeding section 100B includes one or more sheet trays 40 each accommodating a stock of recording sheets S, as well as a sheet conveyance mechanism, including multiple rollers, guide plates, etc., which together define a sheet conveyance path for conveying a recording sheet S from the sheet tray 40 or a manual input sheet tray 34, between a pair of registration rollers 36, then through the secondary transfer nip, and then through the fixing device 60 which fixes the toner image in place on the recording sheet S with heat and pressure. A detailed description of the fixing device 60 and its associated structure will be given later with reference to FIG. 2 and subsequent drawings.

Downstream of the fixing device 60 along the sheet conveyance path is a sheet reversing unit 33 that reverses the recording sheet S after fixing to reintroduce it into the sheet conveyance path where required, as well as an output sheet tray 35 disposed outside the apparatus body to accommodate a finalized print for user pickup.

During operation, each imaging station 1 rotates the photoconductor drum 2 clockwise in the drawing to forward its photoconductive surface to a series of electrophotographic processes, including charging, exposure, development, transfer, and cleaning, in one rotation of the photoconductor drum 2.

First, the photoconductive surface is uniformly charged to a specific polarity by the charging device and subsequently exposed to a modulated laser beam emitted from the exposure device 20. The laser exposure selectively dissipates the charge on the photoconductive surface to form an electrostatic latent image thereon according to image data representing a particular primary color. Then, the latent image enters the development device which renders the incoming image visible using toner. The toner image thus obtained is forwarded to the primary transfer device that electrostatically transfers the primary toner image to the intermediate transfer belt 10 through the primary transfer nip.

Such imaging operation may be performed without employing all the four imaging stations 1Y, 1M, 1C, and 1K. For example, a monochrome image of a particular primary color is formed with only a single imaging station 1 dedicated to the specific primary color, whereas a bi-color or tri-color image is formed with selected two or three imaging stations. In particular, a black-and-white image may be formed with only the black imaging station 1K instead of activating all the four imaging stations.

As the multiple imaging stations 1 sequentially produce toner images of different colors at the four transfer nips along the belt travel path, the primary toner images are superimposed one atop another to form a single multicolor image on the moving surface of the intermediate transfer belt 10 for subsequent entry to the secondary transfer nip between the secondary transfer roller 31 and the backup roller 16.

Meanwhile, the sheet conveyance mechanism picks up a recording sheet S from atop the sheet stack in the sheet tray 40 or the manual input tray 34 to introduce it between the pair of registration rollers 36 being rotated. Upon receiving the incoming sheet S, the registration rollers 36 stop rotation to hold the sheet S therebetween, and then advance it in sync with the movement of the intermediate transfer belt 10 to the secondary transfer nip.

At the secondary transfer nip, the multicolor image is transferred from the belt 10 to the recording sheet S, which is then introduced into the fixing device 60 to fix the toner image in place under heat and pressure. The recording sheet S, thus having its first side printed, is forwarded to a sheet diverter that selectively directs the incoming sheet S to the output sheet tray 35 where simplex printing is intended, or to the sheet reversing unit 33 where duplex printing is intended.

For duplex printing, the sheet reversing unit 33 turns over the incoming sheet S for reentry to the sheet conveyance path, wherein the reversed sheet S again undergoes electrophotographic imaging processes including registration through the registration roller pair 36, secondary transfer through the secondary transfer nip, and fixing through the fixing device 60 to form another print on its second side opposite the first side.

Upon completion of simplex or duplex printing, the recording sheet S is output to the output sheet tray 35 for stacking outside the apparatus body, which completes one operational cycle of the image forming apparatus 100.

Figure 2:
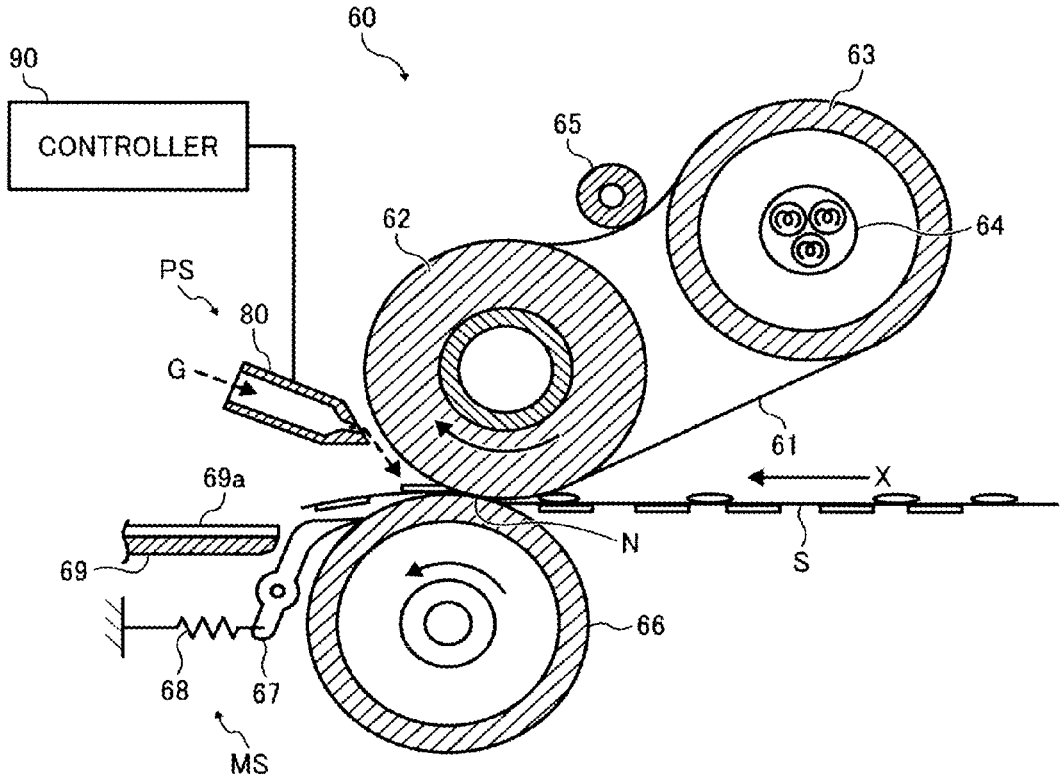
FIG. 2 is an end-on, axial cutaway view schematically illustrating the fixing device incorporated in the image forming apparatus according to one embodiment of this patent specification.

FIG. 2 is an end-on, axial cutaway view schematically illustrating the fixing device 60 incorporated in the image forming apparatus 100 according to one embodiment of this patent specification.

As shown in FIG. 2, the fixing device 60 includes a rotary fuser belt 61 entrained around a fuser roller 62 and a heat roller 63, as well as a rotary pressure roller 66 pressed against the fuser roller 62 through the fuser belt 61 to form a fixing nip N therebetween, all of which extend in an axial, longitudinal direction perpendicular to the sheet of paper on which the FIG. is drawn.

In the present embodiment, the fuser belt 61 comprises a rotatable endless belt looped for rotation around the multiple rotatable rollers 62 and 63. A tension roller 65 is held against the belt 61 outside the belt loop to impart proper tension to the belt 61 between the belt supporting rollers 62 and 63. Alternatively, the tension roller 65 may be disposed inside the belt loop depending on the specific configuration.

The fuser roller 62 comprises a motor-driven rotatable cylinder, consisting of a cylindrical core of metal covered by an elastic layer of silicone rubber or the like deposited thereupon, with a rotary motor connected to the metal core to impart rotation to the cylindrical body.

The heat roller 63 comprises a hollow, rotatable cylinder of thermally conductive material, which accommodates an internal heater 64 in its hollow interior to supply heat to the fuser assembly. Operation of the heater 64 is controlled according to readings of a thermometer or thermistor disposed adjacent to the heat roller 63 to detect temperature of the fuser belt 61, so as to heat the belt 61 properly, for example, to a temperature suitable for fusing toner in use. Heating the fuser assembly may be performed with any suitable heating device, such as a halogen heater or an electromagnetic induction heater, depending on the specific configuration.

The pressure roller 66 comprises a cylindrical roller consisting of a rotatable cylinder covered by an elastic layer of silicone rubber or the like deposited thereupon, equipped with a suitable biasing mechanism that presses the pressure roller 66 against the fuser roller 62. Optionally, the pressure roller 66 may have a dedicated internal heater accommodated in its hollow interior.

Although the present embodiment depicts an endless fuser belt entrained around multiple rollers, alternatively, instead, the rotary fuser member 61 may be configured as any suitable rotatable member, such as an internally heated, hollow cylindrical roller, or a looped piece of thin film rotatable around a heated roll or pipe. Also, although the present embodiment depicts a hollow cylindrical pressure roller, alternatively, instead, the rotary pressure member 66 may be configured as an endless looped belt or other suitable rotatable member. Further, although the present embodiment depicts a motor-driven fuser roller to drive the rotary fixing members, alternatively, a rotary motor may be provided to a pressure roller, a heat roller, or other suitable portion of the fixing assembly.

During operation, the fuser roller 62 rotates in a given direction of rotation (i.e., clockwise in FIG. 2) to rotate the fuser belt 61 in the same rotational direction, which in turn rotates the pressure roller 66 held in contact with the rotating belt 61. The fuser belt 61 during rotation is kept in proper tension with the tension roller 65 pressing against the belt 61 from outside of the belt loop, while having its circumference heated with the heat roller 63 to a given processing temperature sufficient for fusing toner at the fixing nip N.

In this state, a recording sheet S bearing an unfixed, powder toner image T of a particular image density enters the fixing device 60, with its previously imaged side facing the fuser belt 61 and opposite side brought into contact with the pressure roller 66. As the rotary fixing members 61 and 66 rotate together, the recording sheet S proceeds in a sheet conveyance direction X to pass through the fixing nip N, wherein heat from the fuser belt 61 causes toner particles to fuse and melt, while pressure from the pressure roller 66 causes the molten toner to settle onto the sheet surface, thereby fixing the toner image in place on the recording sheet S.

As used herein, the term "conveyance direction" refers to a direction or imaginary plane in which the recording medium or sheet S is passed through the fixing nip N as the rotary fixing members rotate together, and which is substantially perpendicular to the axial, longitudinal direction of the fixing members, as indicated by arrow X in the drawings.

Also, the term "first side" or "first printed side" herein refers to the front side of a recording sheet S, which is subjected to printing firstly during duplex process (or selectively during simplex process), whereas the term "second side" or "second printed side" refers to the back side opposite the front side of a recording sheet S, which is subjected to printing subsequent to printing of the first side during duplex process.

The term "image density" or "density" of a toner image herein refers to a ratio of the image area relative to the entire surface area of a specific side of a recording medium on which the toner image is printed, which is often expressed in the art as an amount of toner loaded per unit surface area of a recording medium. As such, the image density is higher for denser images and lower for lighter images, and hence is highest for a solid or fully colored image and lowest for a blank, uncolored image.

With continued reference to FIG. 2, the fixing device 60 is shown provided with a first, pneumatic sheet stripper PS facing the fuser belt 61, and a second, mechanical sheet stripper MS facing the pressure roller 66, both disposed downstream from the fixing nip N in the conveyance direction X of the recording sheet S.

The pneumatic sheet stripper PS includes one or more pneumatic nozzles 80 disposed adjacent to the fuser belt 61 to direct compressed gas or air G toward the fixing nip N along the fuser belt 61, which forces the leading edge of the recording sheet S away from the fuser belt 61 upon exiting the fixing nip N, thereby pneumatically stripping the recording sheet S from the fuser belt 61. The nozzles 80 are arranged along a length of the fuser roller 62 with an outlet opening thereof directed toward the fixing nip N, while supplied with a suitable gas source to discharge compressed gas G from their outlet openings.

Optionally, such nozzles 80 may be provided in conjunction with an auxiliary, non-contact mechanical sheet stripper, such as a thin-edged plate or a plurality of fingers interposed between the nozzles 80, which can assist pneumatic stripping of the recording sheet without touching the fuser belt 61.

The size, shape, number, and arrangement of the pneumatic nozzles 80 are configured depending on the specific configuration of the fuser assembly. An example of the pneumatic sheet stripper PS will be given later with reference to FIG. 5 and subsequent drawings.

The mechanical sheet stripper MS includes one or more contact fingers or plates 67 disposed in contact with the pressure roller 66 to slide against the pressure roller 66 during rotation, which can engage the leading edge of the recording sheet S exiting the fixing nip N, thereby stripping the recording sheet S from the pressure roller 66.

Each contact finger 67 comprises a swivelable wedge-shaped configuration, thicker at one end and thinner at the other, having its thicker, proximal end connected to a support extending along the length of the pressure roller 66, and its thinner, distal end pointing toward a direction opposite that in which the pressure roller 66 rotates. A biasing member 68 is fixed to the finger 67 opposite the free distal end, which biases the finger 67 so that the finger distal end contacts and slides against the surface of the rotating roller 66.

The contact finger 67 may be formed of fluorine resin, or may be at least partially coated with fluorine resin where it contacts the recording sheet S stripped off the pressure roller 66. For example, the finger 67 may be formed of fluoroplastic with high thermal resistance and low friction, in particular, those suitable for processing through injection molding, such as polytetrafluoroethylene (PTFE) or perfluoroalkoxy (PFA). Other thermally-stable resins, such as polyimide (PI), polyether ether ketone (PEEK), polyetherketone (PEK), polyphenylene sulfide (PPS), or the like may also be used, in which case the material is primarily injection-molded into a desired configuration, which is then surface-treated with a coating of anti-stick material, such as polyester amide (PEA) or PTDFE.

The size, shape, number, and arrangement of the contact fingers 67 are configured depending on the specific configuration of the pressure assembly. An example of the mechanical sheet stripper MS will be given later with reference to FIG. 3 and subsequent drawings.

In the present embodiment, a guide plate 69 is disposed downstream from the contact finger 67 in the sheet conveyance direction X to guide the recording sheet S after stripping from the pressure roller 66.

The guide plate 69 comprises an elongated substrate of metal or resin, such as polyethylene terephthalate (PET) with glass flake (GF) additives, formed through injection molding. The guide plate 69 may be at least partially provided with one or more ribs 69*a* formed of fluorine resin, such as PFA or PTFE, protruding from its operational surface (i.e., the side that directly contacts the recording sheet S stripped off the pressure roller 66), so as to reduce undesired friction between the guide plate 69 and the recording sheet S. Instead of providing the ribs 69*a*, the guide plate 69 may be at least partially coated with fluorine resin, such as PFA and PTFE, for reducing friction at the operational surface, or alternatively, may be provided with a sheet of such low-friction material bonded to the operational surface.

As used herein, the term "recording medium" herein includes any material, such as a sheet of paper, subjected to imaging process including passage through a nip defined between a pair of opposed rotary members disposed opposite each other. Also, the term "stripping" is used to describe removal of a recording medium from a rotary member forming a nip, and the term "stripper" or "stripper finger" refers to any device, such as wedge, blade, plate, or the like, held in contact with, or spaced apart from a rotary member forming a nip to strip a recording medium from the rotary member, as set forth herein.

The inventors have recognized that a fixing device that employs a pneumatic sheet stripper for media stripping from a fuser member often fails to properly convey a recording medium through a fixing nip, in which the recording medium, pneumatically forced away from the fuser member, adheres to a pressure member opposite the fuser member, and eventually wraps around the pressure member, causing a sheet jam or other conveyance failure through the fixing nip.

This is particularly true during duplex printing where the recording medium, having its first side already printed with a dense, high-density image fixed thereon, undergoes a second pass through the fixing nip with its second side being printed with a light, low-density image.

That is, at the fixing nip, heat applied to the recording medium from the fuser member, causes not only the light image on the second side but also the dense image on the first side to exhibit certain adhesion dependent on density of the toner image printed thereupon, which hinders separation of the recording medium from the pressure member. Where the dense image on the first side exhibits a stronger adhesion to the pressure member than does the light image on the second side to the fuser member, pneumatically forcing the recording medium away from the fuser member causes it to readily wrap around the opposite, pressure member, thus causing conveyance failure through the fixing nip.

According to this patent specification, conveyance failure due to wraparound of the recording medium around the fixing member is prevented by combination of the pneumatic sheet stripper PS with the mechanical sheet stripper MS, wherein the pneumatic nozzle 80 directing compressed gas G toward the fixing nip N effectively strips the recording sheet S from the fuser belt 61, whereas the stripper finger 67 held in slidable contact with the pressure roller 66 reliably strips the recording sheet S from the pressure roller 66 even where the recording sheet S has its first side printed with a relatively dense image and second side printed with a relatively light image.

Use of the mechanical sheet stripper MS for the pressure roller 66 does not compromise good imaging quality even where contact with a stripper finger leaves scratches on the roller surface, since unlike the case with the fuser member, the pressure member itself does not directly contact the toner image being processed through the fixing nip, and hence does not significantly affect the configuration of the molten toner which determines image quality of the resulting print.

Further, forming the stripper fingers 67 and the guide plate 69 of fluorine resin or with a coating of such low-friction material protects the fixing device 60 against failures, even where the recording sheet S, blown by compressed air from the pneumatic sheet stripper PS, accidentally slides against the stripper fingers 67 and the guide plate 69 to cause toner to come off the sheet surface, which would otherwise result in smear on the first printed side of the recording sheet, as well as contamination of the stripper and guide surfaces with toner adherent.

Figure 3:
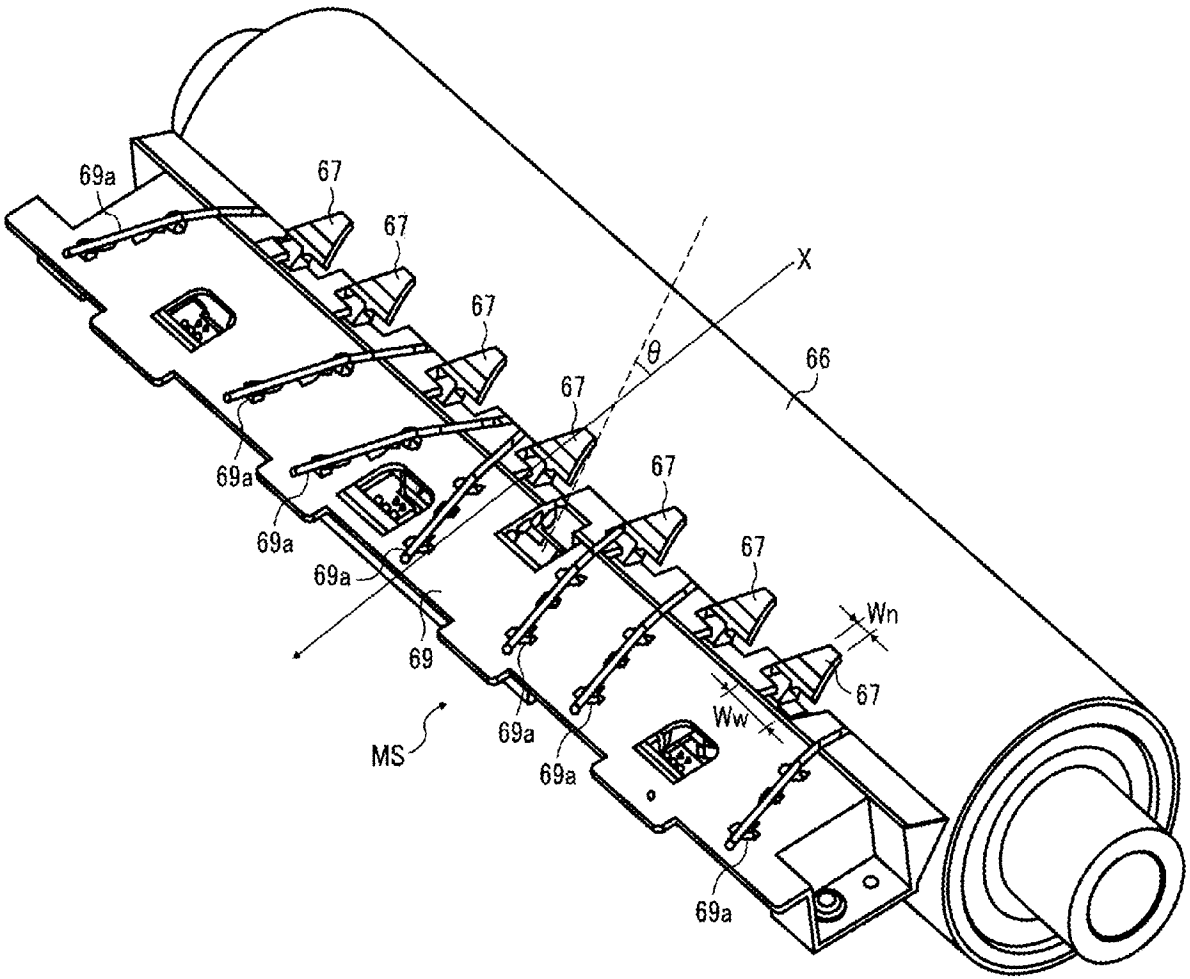
FIG. 3 is a perspective view schematically illustrating an example of a mechanical sheet stripper for a pressure roller included in the fixing device of FIG. 2.

FIG. 3 is a perspective view schematically illustrating an example of the mechanical sheet stripper MS for the pressure roller 66 included in the fixing device 60.

As shown in FIG. 3, the mechanical sheet stripper MS has multiple (e.g., seven in the present embodiment) wedge-shaped fingers 67 arranged in the axial, longitudinal direction of the pressure roller 66, each having the free, distal end in slidable contact with the surface of the pressure roller 66. In a configuration where the pressure roller 66 is movable (e.g., with a cam-operated mechanism) relative to the fuser assembly to adjust pressure at the fixing nip N, contact between the fingers 67 and the roller 66 may be established only where the pressure roller 66 is biased against the fuser assembly to define the fixing nip N.

In the present embodiment, each contact finger 67, when viewed in plan, has its width tapered from a widest width Ww at the fixed, proximal end toward a narrowest width Wn at the free, distal end at an angle θ ranging from approximately 20° to approximately 45° relative to the sheet conveyance direction X. The narrowest width Wn of the finger 67 (i.e., the width at the distal end) may be, for example, approximately 1.0 mm or greater. The contact finger 67 is positioned with the proximal end directed downstream and the distal end directed upstream in the sheet conveyance direction X.

Such arrangement reduces the risk of smearing the toner image on the first printed side through undue interference between the recording sheet S and the stripper fingers 67. Where contact with the stripper fingers 67 does not substantially affect the print quality of the recording sheet S, it is also possible to configure the fingers 67 without width tapering, in which case the finger side edges may align parallel to the sheet conveyance direction X.

The guide plate 69 comprises an injection-molded piece of PET-GF compound with multiple (e.g., seven in the present embodiment) injection-molded PFA ribs 69*a* protruding from its operational surface. For minimizing the risk of smearing the printed face of the recording sheet S, each rib 69*a* may be angled at an angle ranging from approximately 20° to approximately 45° relative to the sheet conveyance direction X.

Experiments were conducted to investigate the effects of providing the stripper finger with width tapering in the sheet conveyance direction X.

In the experiments, a fixing device was prepared including a fuser belt equipped with a pneumatic stripper nozzle and a pressure roller with a slidable contact stripper finger, similar to those depicted in FIG. 2. Duplex printing was performed to print a dense, solid image on a first side, and a blank image on a second side of a relatively thin sheet of copy paper weighing approximately 50 g/m$^2$, using different samples of tapered stripper fingers with their narrowest distal end widths varying in 0.1 mm increments.

The experimental setup simulates a condition where the resulting print is most susceptible to wrapping around the pressure roller to cause concomitant image defects on the second printed side. That is, adhesion resulting from heated toner to resist wraparound of the recording sheet is relatively high at the first side printed with the dense image and relatively low at the second side printed with the light image, and use of thin copy paper makes the resulting image more susceptible to smudges than that obtained with thick copy paper.

Visual inspection was conducted to evaluate image quality of the first side of the resulting duplex prints. Print quality was classified into five categories based on the presence and degree of image defects, in particular, smearing and rub-off, as follows:

A: No defects observed

B: Smearing noticeable only when examined carefully against light

C: Smearing observed

D: Significant smearing observed

E: Significant toner rub-off observed causing vertical lines

Of the five categories depicted above, the preceding two indicate that the print is of good quality and acceptable for practical applications.

Figure 4:
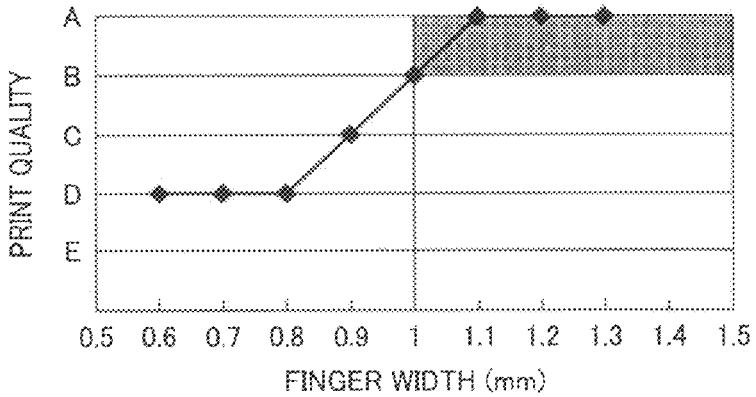
FIG. 4 is a graph showing results of experiments performed to investigate effects of varying width of a stripper finger on quality of resulting printed image.

FIG. 4 is a graph showing results of the visual inspection, in which the quality of the resulting print is plotted against the width Wn of the tapered stripper fingers used in the experiments.

As shown in FIG. 4, the print quality generally increases with the finger width Wn, such that the acceptable print quality (i.e., the categories A and B) is reached where the finger width Wn equals 1.0 mm or greater. The correlation between the print quality and the finger width Wn may be explained by the fact that narrowing the finger width results in an increased contact pressure with which the recording medium slides against the stripper finger edge, and therefore an increased tendency of toner to smear or rub off from the first printed side of the recording medium.

Figure 5:
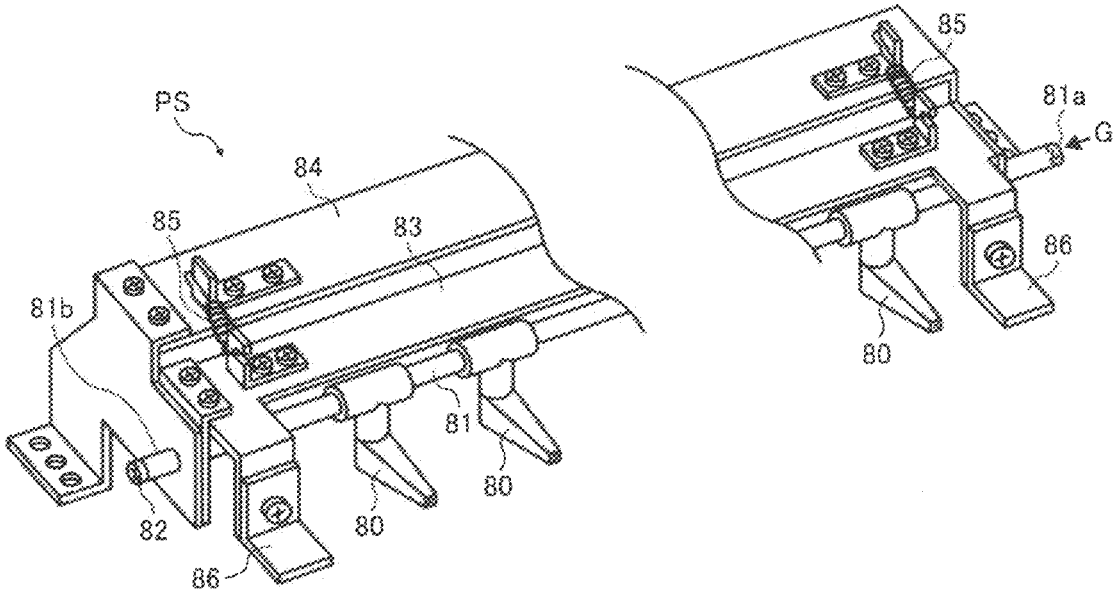
FIG. 5 is a perspective view schematically illustrating an example of a pneumatic sheet stripper for a fuser belt included in the fixing device of FIG. 2.

FIG. 5 is a perspective view schematically illustrating an example of the pneumatic sheet stripper PS for the fuser belt 51 included in the fixing device 60.

As shown in FIG. 5, the pneumatic sheet stripper PS includes a tubular, elongated shaft or manifold 81 on which multiple pneumatic nozzles 80 are rotatably supported, and through which the pneumatic nozzles 80 are supplied with compressed gas G. The pneumatic nozzles 80 are arranged along a length of the manifold 81, with a suitable spacing left between adjoining nozzles 80. In case only a single nozzle 80 is used, such a nozzle 80 may be situated at a substantial center of the manifold 81 in the longitudinal direction of the fuser roller 62.

In the present embodiment, each pneumatic nozzle 80 has an outlet opening for discharging compressed gas at its free, distal end, which may be shaped, for example, in a rectangular configuration with a length and width ranging from approximately 0.5 mm to approximately 2.0 mm, or a circular configuration with a diameter ranging from approximately 0.5 mm to approximately 2.0 mm.

The nozzles 80 may be formed of thermally stable resins, such as PPS, PEEK, PET, and polyether sulfone (PES). For obtaining protection against adhesion of toner, it is possible to form the nozzle 80 of low-friction material, such as PFA, and/or to provide a coating of anti-stick material, such as PEA or PTFE, selectively to the distal end of the nozzle 80 which is most prone to contamination with toner adherents. In case of sinter-coating the anti-stick material, thermally resistant materials, such as PEK, PI, or liquid crystal polymers (LCP), may be used.

The shaft or manifold 81 comprises a tubular elongated body bored with multiple outlet holes each being in fluid communication with an associated one of the multiple pneumatic nozzles 80. The manifold 81 may have its exposed surfaces, in particular, the inner wall of the tube, formed of corrosion-resistant material or protected against corrosion due to drain water originating from compressed gas flowing therethrough. Examples of such material include corrosion-resistant metal, such as stainless steel or aluminum alloy, or other metal, such as sulfur-based free-machinable steel, treated with suitable anti-corrosive plating.

The manifold 81 has one longitudinal end 81*a* defining an opening, and the other, opposite longitudinal end 81*b* sealed with a screw 82 plugged into the tubular body. The open end 81*a* of the manifold 81 is connected with a tubular passage or duct leading to an external compressed gas source, for example, an air pump or compressor combined with an air tank and an electromagnetic valve, through which compressed gas G is conducted to the manifold 81 for supply to the respective nozzles 80.

For good sealing against air and moisture, the manifold 81 may be provided a suitable sealant around the screw 82, such as a thin wrapping of PTFE, or a deposition of suitable additive. Instead of plugging with the screw 82, sealing the manifold 81 may also be accomplished by closing the end 81*b* through welding or adhesion.

With continued reference to FIG. 5, also included in the pneumatic sheet stripper PS is a spring-loaded, elongated stay 83 for supporting the manifold 81 as well as the nozzles 80 supported thereon, which constitutes an elastic biasing mechanism to elastically bias the support 81 of the pneumatic nozzles 80 with respect to the fuser assembly for holding the pneumatic nozzles 80 in position spaced away from the fuser member 61.

The stay 83 and the manifold 81 are positioned stationary with respect to each other, for example, by designing the manifold 81 with a radially asymmetrical cross-section, e.g., a flattened or D-shaped cross-section, where it penetrates through the stay 83, so that the manifold 81 does not rotate with respect to the stay 83. At opposed longitudinal ends of the stay 83 is a pair of flanges 86 that can contact or slide against the fuser belt 61 outboard of a width of recording sheet S, in particular, a maximum compatible sheet width that the fixing device 20 can accommodate through the fixing nip N, so as to maintain the nozzles 80 in proper operational position relative to the fuser member 61.

The stay 83 thus combined with the manifold 81 is supported on a frame 84 affixed (e.g., by screwing) to an enclosure housing of the fixing device 60, so that the elongated assembly extends in the axial, longitudinal direction of the fuser roller 62. The stay 83 and the nozzles 80 supported thereon are rotatable with respect to the frame 84 with the opposed longitudinal ends 81*a* and 81*b* of the manifold 81 each extending outward beyond the stay 83 and connected to the frame 84 via a bearing. Further, the stay 83 is connected to the frame 84 through a tension spring 85 which biases the stay 83 for pressing the flanges 86 against the fuser member.

Figure 6:
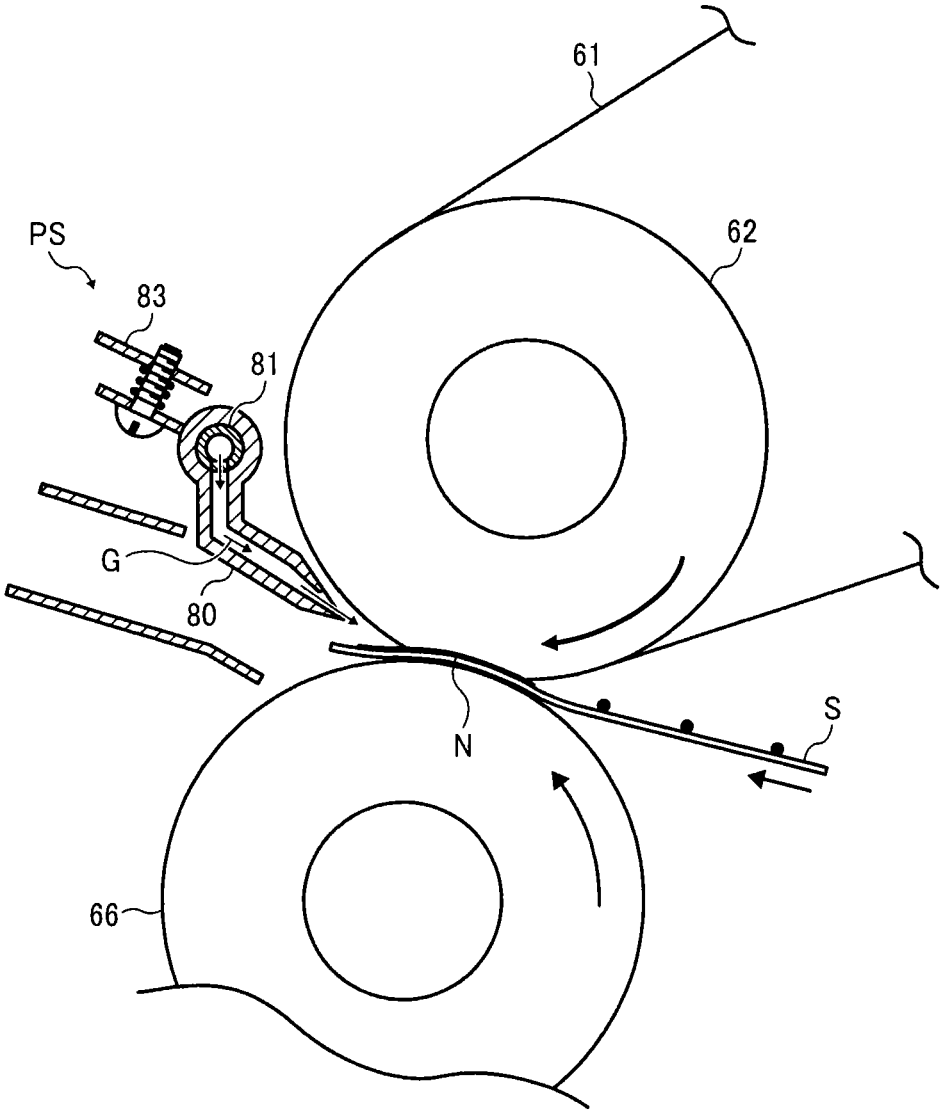
FIG. 6 is an enlarged view of a fixing nip in the fixing device of FIG. 2.

With additional reference to FIG. 6, the pneumatic sheet stripper PS is shown with the pneumatic nozzle 81 positioned with respect to the fuser belt 61. As the spring-loaded stay 83 is elastically biased to press the flange 86 against the fuser belt 61, the pneumatic nozzle 80 swivels around the manifold 81 (i.e., counterclockwise in FIG. 6), so as to establish a proper operational position spaced away from the fuser belt 61. The pneumatic nozzle 80 thus positioned without touching the fuser belt 61 can properly direct a flow of compressed gas G to between the fuser belt 61 and the leading edge of a recording sheet S at the exit of the fixing nip N.

Referring back to FIG. 2, the fixing device 60 is shown provided with a controller 90, such as a central processing unit (CPU) and its associated memory devices, operatively connected to the pneumatic sheet stripper PS.

Specifically, the controller 90 controls operation of the pneumatic sheet stripper PS depending on one or more operating parameters dictating tendency of the recording sheet S to wrap around the fuser belt 61, so as to activate the pneumatic nozzle 80 where the recording sheet S exhibits a greater tendency to wrap around than to separate from the fuser belt 61, and deactivate the pneumatic nozzle 80 where the recording sheet S exhibits a greater tendency to separate from than to wrap around the fuser belt 61.

The inventors have recognized that the wraparound tendency is dependent on various operating parameters, such as type of a recording sheet in use which has a specific thickness and stiffness, density of a toner image printed on the recording sheet, mode of printing (i.e., simplex or duplex, monochrome or full-color, etc.) being executed, with which the fixing device is operated.

For example, a thin recording medium exhibits a greater wraparound tendency than that of a thick recording medium. Also, a high density of toner image (e.g., a photograph or a page with reduced margins at a leading edge) results in an increased wraparound tendency, whereas a low density of toner image (e.g., a blank page) results in a reduced wraparound tendency. Further, a full-color print exhibits a greater tendency than that of a monochrome print, since color printing includes superimposition of toner images of different primary colors, resulting in an increased amount of toner present on the recording medium.

Thus, examples of the operating parameters used by the controller 90 to determine activation or deactivation of the pneumatic nozzle 80 include type of a recording sheet in use, density of a toner image printed on the recording sheet, mode of printing being executed, and any combination thereof, each of which may be derived from programmed or user-specified data, or by analyzing operational conditions detected during operation.

For example, the type of recording sheet S may be obtained based on information input by a user through an operating panel or transmitted from a personal computer connected to the image forming apparatus, or by identifying the input sheet tray used which is associated with a specific type of recording sheet, or through detection with a sensor provided in the sheet conveyance path upstream from the fixing process.

Further, the image density may be obtained based on image data originally captured and converted into a digitized format in digital photocopying application, or image data contained in a print job submitted in printing application, or image data contained in transmitted information in facsimile application.

In the present embodiment, the controller 90 activates or deactivates the pneumatic nozzle 80 depending on combination of thickness of a recording sheet S in use, density of a toner image being fixed, and mode of printing being executed.

Specifically, in controlling the pneumatic sheet stripper PS, the controller 90 determines whether the recording sheet S in use exhibits a thickness greater than a threshold thickness T.

Where the thickness threshold T is exceeded, indicating that the sheet S is easy to separate from the fuser member 61, the controller 90 deactivates the pneumatic sheet stripper PS, so that the recording sheet S, which is intrinsically immune to wrapping around the fuser member 61, can properly pass through the fixing nip N without developing excessive deflection toward the pressure member 66 and concomitant image defects resulting from undesired interference with the mechanical sheet stripper MS.

Contrarily, where the thickness threshold T is not exceeded, indicating that the sheet S is difficult to separate from the fuser member 61, the controller 90 determines whether printing is being performed on the first side or the second side of the recording sheet S, and then activates or deactivates the pneumatic sheet stripper PS depending on whether the toner image printed exhibits an image density greater than a threshold image density D specified for each of the first and second printed sides.

Where printing is being performed on the first side, the controller 90 activates the pneumatic sheet stripper PS where the image density of the first printed side exceeds a first threshold density D1, and otherwise deactivates the pneumatic sheet stripper PS. Where printing is being performed on the second side, the controller 90 activates the pneumatic sheet stripper PS where the image density of the second printed side equals or exceeds a second threshold density D2, and otherwise deactivates the pneumatic sheet stripper PS.

Figure 7:
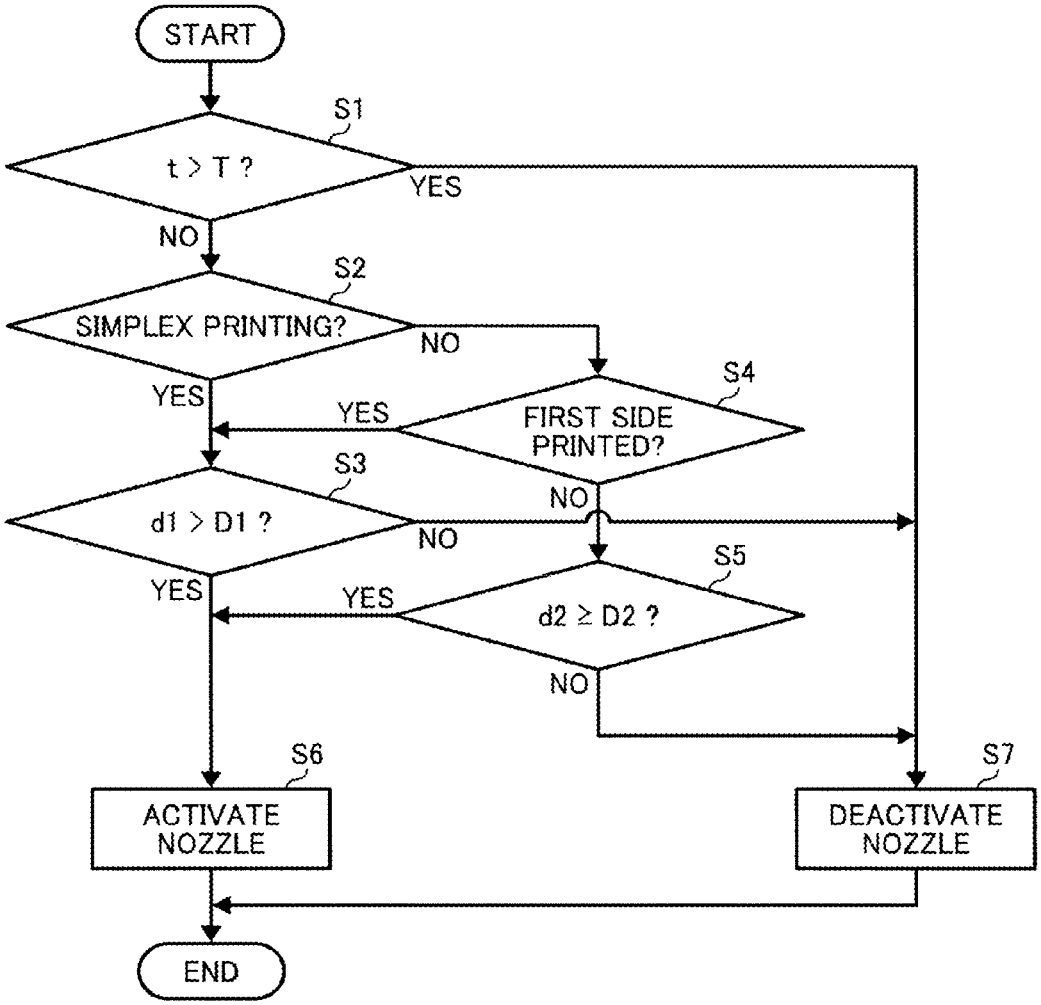
FIG. 7 is a flowchart illustrating an example of pneumatic media stripping control performed in the fixing device of FIG. 2 according to one embodiment of this patent specification.

FIG. 7 is a flowchart illustrating an example of pneumatic sheet stripping control performed by the controller 90 according to the present embodiment.

As shown in FIG. 7, in step S1, the controller 90 initially determines whether the recording sheet S in use has a thickness t greater than a given threshold thickness T. Where the thickness threshold T is not exceeded, that is, the recording sheet S is relatively thin ("NO" in step S1), the controller 90 proceeds to step S2. Where the thickness threshold T is exceeded, that is, the recording sheet S is relatively thick ("YES" in step S1), the controller 90 proceeds to step S7.

In step S2, the controller 90 determines whether the recording sheet S is being subjected to simplex printing or duplex printing. Where simplex printing is being performed ("YES" in step S2), the controller 90 proceeds to step S3. Where duplex printing is being performed ("NO" in step S2), the controller 90 proceeds to step S4.

In step S3, the controller 90 determines whether the image being printed on the first side exhibits an image density d1 greater than a first density threshold D1. Where the first density threshold D1 is exceeded ("YES" in step S3), the controller 90 proceeds to step S6. Where the first density threshold D1 is not exceeded ("NO" in step S3), the controller 90 then proceeds to step S7.

In step S4, the controller 90 determines whether printing is being performed on the first side or the second side of the recording sheet S. Where the first side currently undergoes printing ("YES" in step S4), the controller 90 proceeds to step S3 to determine whether the first density threshold D1 is exceeded, as described above. Where the second side currently undergoes printing ("NO" in step S4), the controller 90 proceeds to step S5.

In step S5, the controller 90 determines whether the image being printed on the second side exhibits an image density d2 greater than a second density threshold D2. Where the second density threshold D2 is equaled or exceeded ("YES" in step S5), the controller 90 proceeds to step S6. Where the second density threshold D2 is not equaled or exceeded ("NO" in step S5), the controller 90 proceeds to step S7.

In step S6, the controller 90 activates the pneumatic sheet stripper PS, so that the recording sheet S, with its leading edge blown off the fuser belt 61 by compressed gas from the nozzles 80, can properly pass through the fixing nip P without wrapping around the fuser belt 61.

In step S7, the controller 90 deactivates or does not activate the pneumatic sheet stripper PS, so that the recording sheet S can properly pass through the fixing nip P without undesirable interference with the mechanical sheet stripper MS and concomitant image defects.

Thus, provision of the pneumatic stripping controller 90 allows the pneumatic sheet stripper PS to activate only where the recording sheet S exhibits a greater tendency to wrap around the fuser member 61, thereby preventing adverse effects caused where the recording sheet S pneumatically forced away from the fuser belt 61 excessively deflects toward the pressure roller 66, resulting in smearing or smudges on the first printed face of the recording sheet S or other failure in conveyance through the fixing nip N.

Specifically, where the recording sheet S in use is relatively thick and hence is readily separable from the fuser belt 61, the pneumatic stripper PS remains inactive and hence does not cause the recording sheet S to excessively deflect toward the pressure roller 66. Moreover, where the recording sheet S in use is relatively thin, the pneumatic sheet stripper PS is activated only where the toner image being processed is relatively dense, and therefore exhibits a relatively high adhesion to the fuser belt 61.

Hence, the fixing device 60 according to this patent specification is effectively protected against conveyance failure due to a recording medium wrapping around a pressure member when pneumatically stripped from a fuser member, owing to the combined use of the first, pneumatic media stripper PS and the second, mechanical media stripper MS, the former for the fuser member 61 and the latter for the pressure member 66, wherein the pneumatic nozzle 80 directing compressed gas G toward the fixing nip N effectively strips the recording medium S from the fuser member 61, whereas the stripper finger 67 held in slidable contact with the pressure member 66 reliably strips the recording medium S from the pressure member 66 even where the recording sheet S tends to adhere to the pressure member 66 upon exiting the fixing nip N.

Such protection against media conveyance failure due to wraparound may be effectively carried out through provision of the pneumatic stripping controller 90 operatively connected to the first media stripper PS to activate or deactivate the pneumatic nozzle 80 depending on one or more operating parameters dictating tendency of the recording medium S to wrap around the fuser member 61.

Although in several embodiments depicted above, the fixing device is configured as a belt-based assembly including an endless, rotary fuser belt paired with a rotary pressure roller, the media stripping mechanism according to this patent specification may be applicable to any type of fixing device that includes a pair of rotary fuser and pressure members disposed opposite to each other to form a fixing nip therebetween.

Further, although in several embodiments depicted above, the image forming apparatus is configured as a tandem color printer that employs four imaging stations arranged sequentially along an intermediate transfer belt, alternatively, instead, the media stripping mechanism according to this patent specification may be applicable to any type of imaging system that incorporates a fixing capability to fix a toner image in place on a recording medium conveyed thorough a fixing nip.

For example, the printer section may employ any number of imaging stations or primary colors associated therewith, e.g., a full-color process with three primary colors, a bi-color process with two primary colors, or a monochrome process with a single primary color. The order in which the multiple imaging stations are arranged sequentially along the intermediate transfer belt may be different than that depicted herein.

Further, instead of a tandem printing system, the printing section may employ any suitable imaging process for producing a toner image on a recording medium, such as one that employs a single photoconductor surrounded by multiple development devices for different primary colors, or one that employs a photoconductor in conjunction with a rotary or revolver development system rotatable relative to the photoconductive surface. Also, the printer section may include any suitable transfer process, either direct or non-direct, for transferring a toner image from an imaging surface to a recording medium.

Furthermore, the image forming apparatus according to this patent specification may be applicable to any type of electrophotographic imaging systems, such as photocopiers, printers, facsimiles, and multifunctional machines incorporating several of such imaging functions.

Numerous additional modifications and variations are possible in light of the above teachings. It is therefore to be understood that, within the scope of the appended claims, the disclosure of this patent specification may be practiced otherwise than as specifically described herein.

What is claimed is:

1. A fixing device for fixing a toner image in place on a recording medium, the fixing device comprising:

a rotary fuser member subjected to heating;

a rotary pressure member pressed against the fuser member to form a fixing nip therebetween through which the recording medium is passed in a media conveyance direction under heat and pressure as the fuser and pressure members rotate together;

at least one pneumatic nozzle disposed adjacent to the fuser member to direct compressed gas toward the fixing nip along the fuser member for stripping the recording medium from the fuser member;

at least one contact finger disposed in contact with the pressure member to slide against the pressure member during rotation for stripping the recording medium from the pressure member; and a controller operatively connected to the at least one pneumatic nozzle to activate or deactivate the at least one pneumatic nozzle depending on one or more operating parameters dictating tendency of the recording medium to wrap around the fuser member, wherein the one or more operating parameters include at least one of a thickness of recording medium in use, a density of the toner image being fixed onto the recording medium, and a mode of printing being executed, and wherein the pneumatic nozzle is deactivated where the thickness of the recording medium in use exceeds a threshold thickness.

2. The fixing device according to claim 1, wherein the pneumatic nozzle is activated where the density of the toner image being fixed exceeds a threshold density.

3. The fixing device according to claim 1, wherein the pneumatic nozzle is activated where the thickness of the recording medium in use exceeds a threshold thickness, and where the density of the toner image being fixed exceeds a threshold density.

4. The fixing device according to claim 1, wherein the recording medium has a first side thereof printed firstly at a first pass through the fixing nip, and a second side thereof printed secondly at a second pass subsequent to the first pass through the fixing nip during duplex printing, the pneumatic nozzle is activated firstly at the first pass where the density of the toner image being fixed on the first side exceeds a first threshold density, and secondly at the second pass where the density of the toner image being fixed on the second side equals or exceeds a second threshold density different from the first threshold density.

5. The fixing device according to claim 1, wherein the contact finger is at least partially formed of fluorine resin.

6. The fixing device according to claim 1, wherein the contact finger is at least partially coated with fluorine resin where it contacts the recording medium stripped off the pressure member.

7. The fixing device according to claim 1, further comprising a guide plate disposed downstream from the contact finger in the media conveyance direction to guide the recording medium after stripping from the pressure member.

8. The fixing device according to claim 7, wherein the guide plate is at least partially coated with fluorine resin where it contacts the recording medium stripped off the pressure member.

9. The fixing device according to claim 7, wherein the guide plate includes a sheet of fluorine resin to define a surface that contacts the recording medium stripped off the pressure member.

10. The fixing device according to claim 7, wherein the guide plate is at least partially provided with a rib where it contacts the recording medium stripped off the pressure member.

11. The fixing device according to claim 10, wherein the rib is formed of fluorine resin.

12. A fixing device for fixing a toner image in place on a recording medium, the fixing device comprising:

a rotary fuser member subjected to heating;

a rotary pressure member pressed against the fuser member to form a fixing nip therebetween through which the recording medium is passed in a media conveyance direction under heat and pressure as the fuser and pressure members rotate together;

at least one pneumatic nozzle disposed adjacent to the fuser member to direct compressed gas toward the fixing nip along the fuser member for stripping the recording medium from the fuser member;

at least one contact finger disposed in contact with the pressure member to slide against the pressure member during rotation for stripping the recording medium from the pressure member;

a controller operatively connected to the at least one pneumatic nozzle to activate or deactivate the at least one pneumatic nozzle depending on one or more operating parameters dictating tendency of the recording medium to wrap around the fuser member, wherein:

the contact finger has a width tapered from a widest width at a proximal end thereof to a narrowest width at a distal end thereof, and the contact finger being positioned with the proximal end directed downstream and the distal end directed upstream in the media conveyance direction.

13. The fixing device according to claim 12, wherein the narrowest width of the contact finger is approximately 1 millimeter or greater.

14. The fixing device according to claim 12, wherein the contact finger is tapered in width at an angle ranging from approximately 20° to approximately 45° relative to the media conveyance direction.

15. A fixing device for fixing a toner image in place on a recording medium, the fixing device comprising:

a rotary fuser member subjected to heating;

a rotary pressure member pressed against the fuser member to form a fixing nip therebetween through which the recording medium is passed in a media conveyance direction under heat and pressure as the fuser and pressure members rotate together;

at least one pneumatic nozzle disposed adjacent to the fuser member to direct compressed gas toward the fixing nip along the fuser member for stripping the recording medium from the fuser member;

at least one contact finger disposed in contact with the pressure member to slide against the pressure member during rotation for stripping the recording medium from the pressure member;

a controller operatively connected to the at least one pneumatic nozzle to activate or deactivate the at least one pneumatic nozzle depending on one or more operating parameters dictating tendency of the recording medium to wrap around the fuser member; and a tubular, elongated shaft on which the at least one pneumatic nozzle is rotatably supported and through which the pneumatic nozzle is supplied with compressed gas.

16. A fixing device for fixing a toner image in place on a recording medium, the fixing device comprising:

a rotary fuser member subjected to heating;

a rotary pressure member pressed against the fuser member to form a fixing nip therebetween through which the recording medium is passed in a media conveyance direction under heat and pressure as the fuser and pressure members rotate together;

at least one pneumatic nozzle disposed adjacent to the fuser member to direct compressed gas toward the fixing nip along the fuser member for stripping the recording medium from the fuser member;

at least one contact finger disposed in contact with the pressure member to slide against the pressure member during rotation for stripping the recording medium from the pressure member;

a controller operatively connected to the at least one pneumatic nozzle to activate or deactivate the at least one pneumatic nozzle depending on one or more operating parameters dictating tendency of the recording medium to wrap around the fuser member; and an elastic biasing mechanism to elastically bias a support of the pneumatic nozzle for holding the at least one pneumatic nozzle in position spaced away from the fuser member.

* * * * *